US005320338A

United States Patent [19]

Shinohara et al.

[11] Patent Number: 5,320,338

[45] Date of Patent: Jun. 14, 1994

[54] CASSETTE

[75] Inventors: Masahiro Shinohara; Kazumi Shirasaka; Akinobu Nakahata; Kenji Oda; Masami Fuchi; Yoshinori Makiura, all of Osaka; Kouji Migita, Fukuoka, all of Japan

[73] Assignee: Mita Industrial Co., Ltd., Osaka, Japan

[21] Appl. No.: 14,435

[22] Filed: Feb. 5, 1993

[30] Foreign Application Priority Data

Feb. 14, 1992 [JP] Japan ..... 4-028383
Feb. 14, 1992 [JP] Japan ..... 4-028385

[51] Int. Cl.[5] ..... B65H 1/22

[52] U.S. Cl. ..... 271/164; 271/169; 271/126

[58] Field of Search ..... 271/170, 171, 169, 167, 271/164, 162, 160, 126, 127

[56] References Cited

U.S. PATENT DOCUMENTS

| | | | |
|---|---|---|---|
| 4,828,245 | 5/1989 | Shimogawara | 271/171 |
| 5,184,906 | 2/1993 | Czernik | 271/127 |
| 5,199,695 | 9/1993 | Nakahata et al. | 271/171 |

FOREIGN PATENT DOCUMENTS

| | | | |
|---|---|---|---|
| 0386737 | 9/1990 | European Pat. Off. | 271/170 |
| 0056224 | 3/1987 | Japan | 271/171 |

*Primary Examiner*—H. Grant Skaggs
*Attorney, Agent, or Firm*—Jordan and Hamburg

[57] ABSTRACT

A cassette is attachable to an image forming apparatus including a feed roller. The cassette is provided with a push-up member for pushing up leading edges of sheets placed in the cassette so as to bring the uppermost one of the contained sheets into contact with the feed roller, and a restricting member for restricting displacement of the contained sheets from a specified position. By attaching thus constructed cassette to the image forming apparatus, sheets can be fed properly by the feed roller.

16 Claims, 8 Drawing Sheets

CASSETTE

BACKGROUND OF THE INVENTION AND RELATED ART STATEMENT

This invention relates to a cassette attachable to feeder of a printer, copying machine, or like image forming apparatus.

A cassette for use in an image forming apparatus such as a printer and a copying machine is provided with a pair of upright side plates which are provided at opposite lateral ends of a sheet holding plate and are slidable in a direction perpendicular to a sheet feeding direction (hereinafter referred to as a lateral direction). By moving these side plates up to positions where these plates are in contact with left and right lateral edges of sheets contained in the cassette, cut sheets of A4 size, B5 size, or the like, and various envelopes of specified sizes and unspecified sizes are allowed to be aligned and contained on the sheet holding plate. When this cassette is attached to the feeder of the image forming apparatus, the sheets contained in the cassette are lifted by an upward biasing force given from the sheet holding plate, thereby being brought into pressing contact with a feed roller. The sheets are fed by rotation of the feed roller.

Sheet pressing members are provided at opposite front ends of the cassette so as to hold a leading edge of an uppermost sheet. The sheet pressing members are slidable in the lateral direction integrally with the side plates. Thereby, the sheets are prevented from floating. The pair of side plates restrict the transport of sheets in the lateral direction, thereby preventing an oblique feeding of sheet.

Since the side plates are required to be in contact with the corresponding lateral edges of the uppermost sheet reliably, an upper end of each side plate is located above a lower end of a circumferential surface of the feed roller when the cassette is attached to the feeder of the image forming apparatus. Further, since the sheet pressing members press the uppermost sheet, an upper end of each sheet pressing member is also located above the lower end of the circumferential surface of the feed roller.

Thus, particularly in the case where the side plates and the sheet pressing members are moved laterally inward of the cassette so as to contain sheets of narrow width such as envelopes in the cassette, the side plates and the sheet pressing members strike against the feed roller when the cassette is attached or detached to or from the image forming apparatus. This causes the inconvenience that the feed roller, the side plates, and the sheet pressing members are deformed or damaged. In view of the above inconvenience, it can be considered to arrange the feed roller within the width of the smallest possible sheet contained in the cassette. However, if the feed roller is arranged near the lateral center of the cassette, it becomes difficult to feed the large size sheets properly.

On the other hand, in the case where envelopes formed into a flat container by folding the sheet are contained in the cassette, corners of some of the envelopes project outward from the lateral sides thereof. Accordingly, there outward projecting corners are brought into pressing contact with the side plates, which becomes a load against the upward biasing force given from the sheet holding plate and the envelopes cannot be lifted properly. As a result, the envelopes cannot be brought into pressing contact with the feed roller properly, and the envelopes cannot be transported.

SUMMARY OF THE INVENTION

In view of the problems residing in the prior art, it is an object of the invention to provide a cassette which prevents deformation and damage caused by a sheet pressing member thereof striking against a feed roller when the cassette is attached or detached to or from an image forming apparatus, and is capable of feeding even narrow envelopes properly and reliably.

Accordingly, the invention is directed to a cassette attachable to an image forming apparatus including a feed roller. This cassette comprises push-up means for pushing up leading edges of sheets contained in the cassette so as to bring the uppermost one of the contained sheets into contact with the feed roller; and restricting means for restricting displacement of the contained sheets from a specified position.

With thus constructed cassette, the contained sheets can be fed from the uppermost one by the feed roller while restricting displacement thereof from the specified position.

The restricting means may preferably include a sheet pressing member provided movably vertically in the vicinity of the leading edges of the contained sheets and adapted for restricting vertical displacement of the contained sheets.

With this arrangement, since the sheet pressing member lowers upon coming to contact with the feed roller, an impact generated when the feed roller comes to contact with the sheet pressing member can be cushioned.

The sheet pressing member may be advantageously movable in the widthwise direction of the cassette. In thus construction cassette, the displacement of the contained sheets can be restricted properly regardless of the size thereof.

The restricting means may further include a pair of intermediate restricting members for restricting widthwise displacement of the contained sheets. The intermediate restricting members are arranged at opposite lateral sides behind the sheet pressing members movably in the widthwise direction of the cassette.

With this arrangement. the contained sheets can be fed from the uppermost one by the feed roller while restricting the widthwise displacement thereof from the specified position.

The restricting means may include advantageously an intermediate restricting member for restricting widthwise displacement of the contained sheets and a front restricting member for restricting forward displacement of the contained sheets. The intermediate restricting member includes a side wall provided upright at an intermediate portion of each lateral side of the contained sheets. The front restricting member includes a side wall provided upright at a front end of each lateral side of the contained sheets. The side walls of the front restricting member are positioned outward of the corresponding side walls of the intermediate restricting member by a specified length in the widthwise direction.

With this arrangement, when the spacing between the side walls of the intermediate restricting member is set in correspondence with the width of envelopes which are one type of sheets to be contained in the cassette, the side walls of the front restricting member are spaced apart wider than that spacing. Accordingly, even if an envelope has outward projecting corners at a leading edge portion thereof, the envelope is not pressed between the side walls of the front restricting member and is pressed against the feed roller so as to be fed properly.

These and other objects, features and advantages of the present invention will become more apparent upon a reading of the following detailed description and accompanying drawings.

DETAILED DESCRIPTION OF THE PREFERRED EMBODIMENTS OF THE INVENTION

Figure 1:
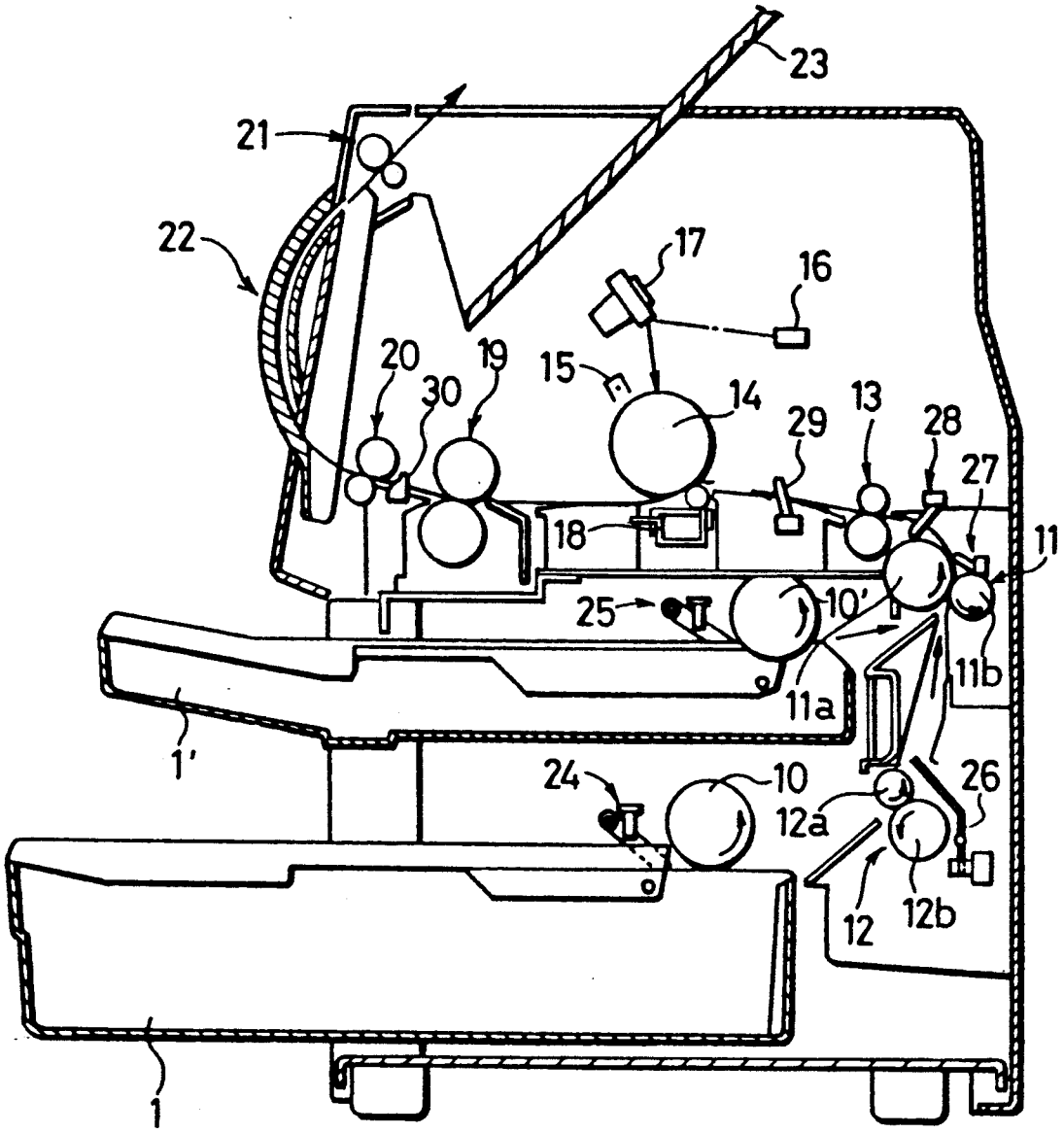
FIG. 1 is a sectional view showing a schematic construction of an image forming apparatus to which a cassette according to the invention is attached.

There will be first described a schematic construction of an image forming apparatus to which a cassette embodying the invention is attached with reference to FIG. 1.

The image forming apparatus is provided with a plurality of cassettes 1, 1', feed rollers 10, 10', a first pair of separating rollers 11, a second pair of separating rollers 12, a pair of registration rollers 13, a photosensitive member 14 in the form of a drum, a charger 15 and other unillustrated imaging devices arranged around the member 14, a light emitting device 16, a polygonal mirror 17, a transfer device 18, a fixing device 19, pairs of discharge rollers 20, 21, a discharge guide 22, a discharge tray 23, etc. The first separating roller pair includes a forward roller 11*a* and a retard roller 11*b*, and a second separating roller pair includes a forward roller 12*a* and a retard roller 12*b*. The light emitting device 16 includes a laser beam emitter for emitting a laser beam to print an image.

The image forming apparatus is further provided with sheet sensors 24, 25, multifeed sensors 26, 27, a registration sensor 28, a timing sensor 29, a discharge sensor 30, and the like. The sheet sensors 24, 25 detect the presence or absence of sheets in the cassettes 1, 1' respectively. The multifeed sensors 26, 27 detect the multiple feeding of sheets. The registration sensor 29 is adapted for measuring a timing at which the registration rollers 13 are driven. The timing sensor 29 is adapted for measuring a timing at which the light emitting device 17 starts emitting the light. The discharge sensor 30 detects discharge of the sheet.

In the image forming apparatus thus constructed, sheets are dispensed, for example, from the lower located cassette 1, are separated and transported one by one by the second separating rollers 12. The separated sheet is nipped by the registration rollers 13 after passing between the first separating rollers 11. When the sheets are fed from the cassette 1, the retard roller 11*b* is rotated idly. Accordingly, the sheet having passed between the second separating rollers 12 is permitted to pass between the first separating rollers 11 smoothly. It is controllably discriminated based on a data from a cassette information unit (not shown) provided at a front portion of the cassette 1 whether the retard roller 11*b* should be driven or not. The cassette information unit consists of four bits, and a magnet is mounted to each of desired bits thereof. Alternatively, the driving of the retard roller 11*b* is controlled based on which of the upper and lower cassettes 1 is selected through manual designation. The registration rollers 13 are driven controllably in accordance with a signal from the registration sensor 28.

Thereafter, when the registration rollers 13 start transporting the sheet and a sensor signal is output from the timing sensor 29, the photosensitive member 14 is driven in accordance with this sensor signal and image signals input from an unillustrated data storage of a storage medium externally connected to the image forming apparatus or arranged at a specified position thereof are optically modulated into modulated beams (laser beams) in the light emitting device 16, and emitted therefrom. The photosensitive member 14 is exposed to this laser beam introduced by way of the polygonal mirror 17. It may be appropriate to drive the photosensitive member 14 at a timing when the driving of the feed roller 10 is started. The surface of the photosensitive member 14 is charged by the charger 15, and an electrostatic latent image is formed on a charged region of the member 14 by an exposing operation. Thus formed electrostatic latent image is developed into a toner image by an unillustrated developing device. This toner image is transferred to a sheet by the transfer device 18, and then fixed onto the sheet by the fixing device 19. Consequently, the sheet bearing the image is discharged onto the discharge tray 23 through the pairs of discharge rollers 20, 21 and the discharge guide 22.

Figure 2:
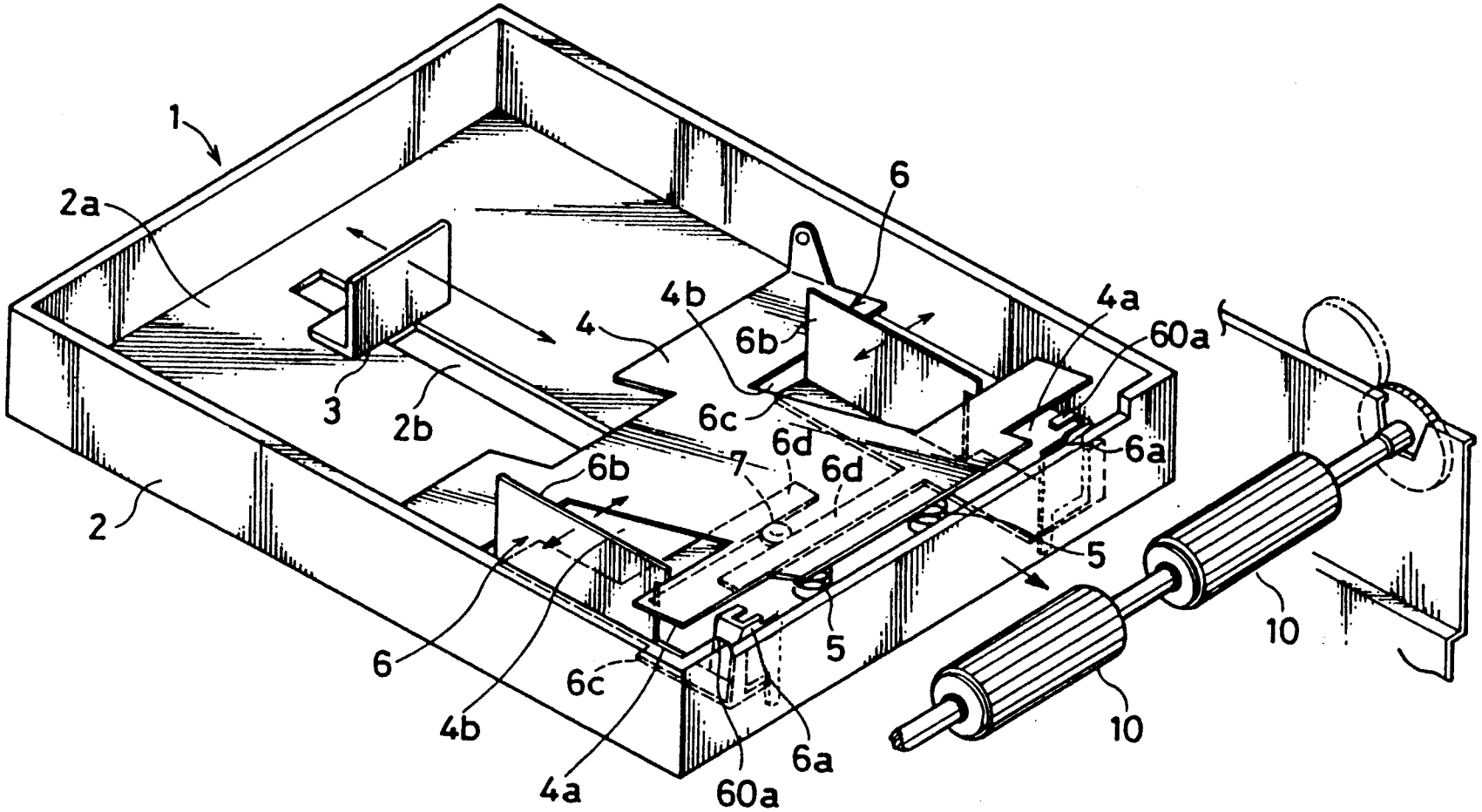
FIG. 2 is a perspective view showing a first cassette embodying the invention.
Figure 3:
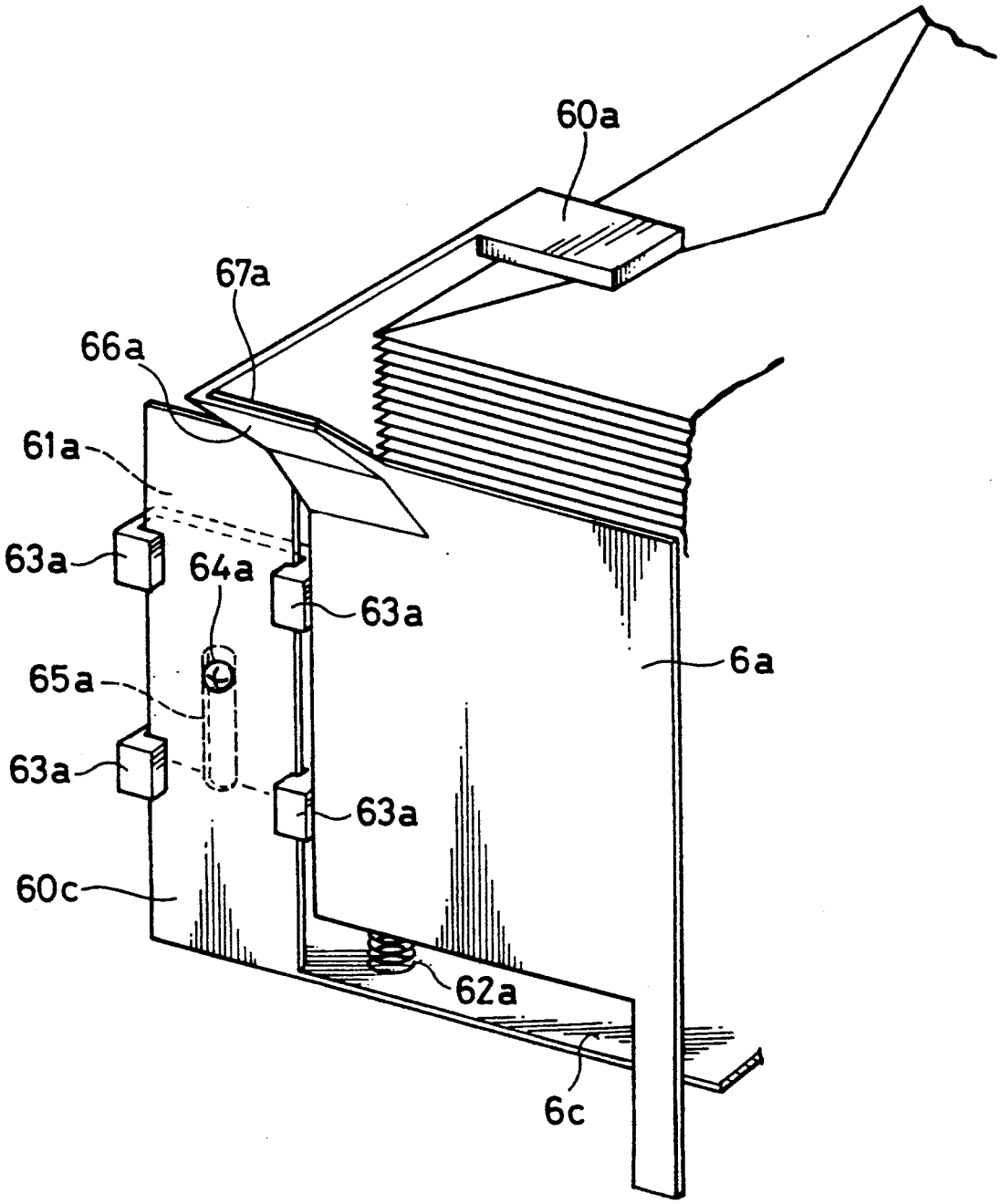
FIG. 3 is a perspective view showing a front side plate of the first cassette.

There will be described a first cassette embodying the invention next with reference to FIGS. 2 and 3.

A first cassette 1 is adapted for containing cut sheets and sheet materials such as envelopes therein. The cassette 1 includes a cassette main body 2 formed into a box-like figure, a trailing edge regulating member 3, a sheet holding plate 4 for holding sheets thereon, helical springs 5, a pair of side plates 6 arranged at left and right sides (sides parallel with a sheet feeding direction) of the cassette main body 2, etc. By attaching the cassette 1 to the image forming apparatus, sheets in the cassette 1 are allowed to be fed by the feed roller 10.

The trailing edge regulating member 3 has at a bottom end thereof an engaging portion engageable with a guide groove 2*b* which is defined in a bottom plate 2*a* of the cassette main body 2 and extends in the sheet feeding direction. The member 3 slides forward and backward along the guide groove 2*b* to thereby align the trailing edges of the sheets. The sheet holding plate 4 is supported rotatably by shafts disposed at specified positions of the side walls of the cassette main body 2, and a leading end thereof is pivotable vertically. At opposite lateral side portions of the sheet holding plate 4 are formed cut-away portions 4*a*, 4*b*, such that the sheet holding plate 4 does not prevent front and rear side plates 6*a* and 6*b* to be described later from moving inward with respect to a widthwise direction of the cassette 1. A desired number of helical springs 5 are provided between the sheet holding plate 4 and the bottom plate 2a so as to bias and lift the leading end of the sheet holding plate 4. By the biasing force of these helical springs 5, the uppermost sheet of the sheets placed on the sheet holding plate 4 is brought into contact with pressing member 60a of the front side plates 6a, and thereby a desired pressing force is attained between the cassette 1 and the feed roller 10 in a state where the cassette I is attached to the image forming apparatus.

Each side plate 6 consists essentially of the front side plate 6a, the rear side plate 6b, a base portion 6c, and a rack portion 6d. The front side plate 6a is mounted to the side plate 6 through a guide plate 60c to be described later. The base portion 6c is held between the bottom plate 2a of the cassette main body 2 and the sheet holding plate 4. At a front end of each base portions 6c is provided the guide plate 60c which supports the front side plate 6a movably upward and downward. Accordingly, the front side plates 6a are movable upward and downward independently of the rear side plates 6b. The front and rear side plates 6a and 6b are adapted for restricting a lateral movement of sheets and feeding the sheets toward the feed roller 10 accurately.

The front side plate 6a is formed of synthetic resin or the like, and includes the pressing member 60a, a slidable member 61a, and a spring 62a. Front end portions of the front side plates 6a are bent laterally inward of the cassette 1 at a right angle so as to align leading edges of the sheets. A guide portion 66a extends obliquely upward from the top of the front end of the front side plate 6a. The guide portion 66a guides the sheets to be fed from the cassette main body 2 by the feed roller 10 to the pairs of separating rollers 11, 12 located above the cassette 1.

Further, a notch 68a is defined in the front side plate 6a, such that the feed roller 10 is not contact with the front side plate 6a when the cassette 1 is attached to the image forming apparatus.

On the guide portion 66a is adhered a friction pad 67a. Further, between the friction pad 67a and the lower end of the feed roller 10 is defined a clearance which is twice the thickness of two sheets (two envelopes). When two sheets are dispensed out of sheets placed on the sheet holding plate 4 through this clearance to the guide portion 66a, a lower sheet comes to contact with the friction pad 67a and transport thereof is deterred due to a frictional force generated between this sheet and the friction pad 67a. Accordingly, only an upper sheet of the two (i.e., the uppermost sheet) is fed.

The pressing member 60a extends laterally inward of the cassette main body 2 from an upper end of a lateral face of the front side plate 6a, and is adapted for pressing the leading end of the uppermost one of sheets placed on the sheet holding plate 4.

The slidable member 61a extends laterally outward of the cassette main body 2 from the front side plate 6a, and holds the front side plate 6a tightly slidably upward and downward with the use of a required number of hooks formed at opposite lateral ends thereof. On the slidable member 61a is defined an oblong groove 65a extending vertically. On the guide plate 60c is formed a pin 64a including a small screw or the like projecting backward. By loosely fitting this pin 64a in the oblong groove 65, a movable range of the front side plate 6a is restricted (between a position shown in FIG. 4 and a position shown in FIG. 5). The spring 62a is provided between the front side plate 6a and the base portion 6c so as to bias the front side plate 6a upward.

The rack portion 6d extends laterally inward of the cassette main body 2 from a specified inner lateral position of each base portion 6c. The rack portions 6d of the opposite site side plates 6 are spaced apart by a given distance in parallel with each other, and are meshable with a pinion 7 mounted at a widthwise center of the bottom plate 2a therebetween. With this arrangement, the opposite side plates 6 are movable toward or away from each other simultaneously along the widthwise direction of the cassette 1. Since the front and rear side plates 6a, 6b are movable within the width of the sheet holding plate 4 in this way, the cassette 1 is capable of containing therein not only cut sheets of large size but also envelopes of small size.

Further, the front side plates 6a formed of synthetic resin or the like serve to cushion an impact generated when the front side plates 6a come to contact with the feed roller 10 in attaching or detaching the cassette 1.

There will be described an operation when thus constructed cassette 1 is attached or detached to or from the image forming apparatus next with reference to FIGS. 4 and 5. Here, it is assumed that narrow sheets such as envelopes are contained in the cassette main body 2 and the side plates 6 are moved to the position of the feed roller 10.

The cassette 1 is inserted to a cassette inserting portion of the image forming apparatus to be attached thereto. At this time, the upper ends of the front side plates 6a and the pressing members 60a are located above the lower end of the circumferential surface of the feed roller 10. As the cassette l is inserted more, the feed roller 10 comes to contact with the front side plates 6a and the pressing members 60a. Thereby, the front side plates 6a are pressed downward to be thereby lowered against the biasing force of the springs 62a as shown in FIG. 4.

When the cassette 1 is inserted further into the cassette inserting portion, the feed roller 10 moves over the front side plates 6a and is positioned between the front side plates 6a and the rear side plates 6b. At this time, the feed roller 10 gets out of contact with the upper ends of the front side plates 6a and the pressing members 60a, thus the front side plates 6a are elevated due to the biasing force of the springs 62a and return to the position shown in FIG. 5. In this state, the sheets contained in the cassette 1 are allowed to be fed by the feed roller 10.

Figure 4:
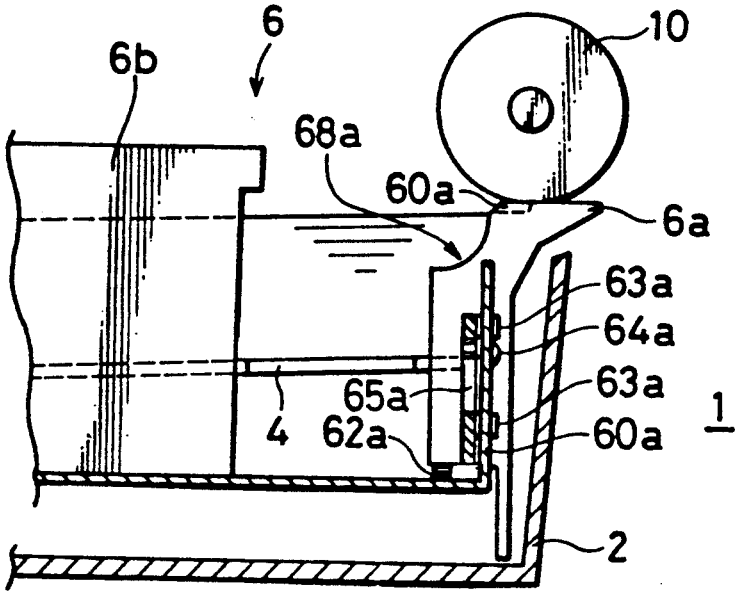
FIG. 4 is a fragmentary perspective view showing an action when the first cassette is attached or detached.
Figure 5:
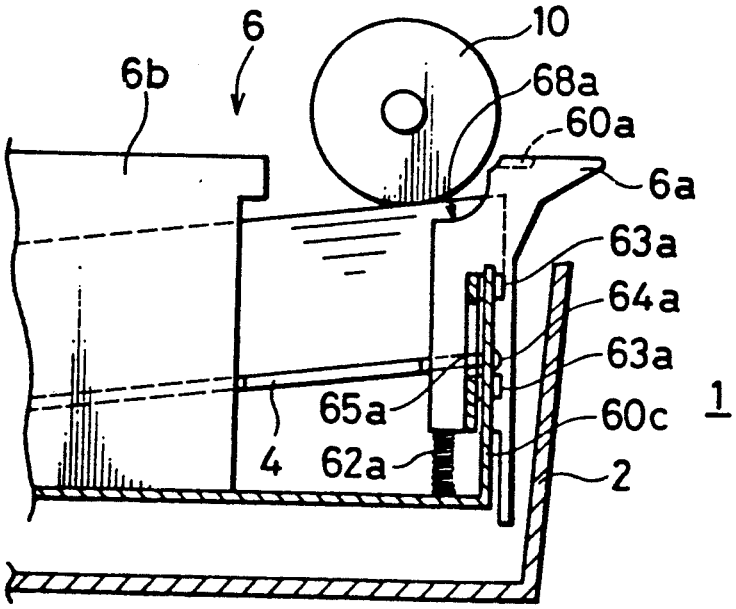
FIG. 5 is a fragmentary perspective view showing an action when the first cassette is attached or detached.

On the other hand, when the cassette 1 is moved backward to be detached from the image forming apparatus, the feed roller 10 comes to contact with the upper ends of the front side plates 6a and the pressing members 60a to thereby lower the front side plates 6a similar to the aforementioned case (see FIG. 4). When the cassette 1 is moved further backward, the upper ends of the front side plates 6a and the pressing members 60a get out of contact with the feed roller 10, and the front side plates 6a return to the position shown in FIG. 5 by the biasing force of the springs 62.

In this way, even when the feed roller 10 comes to contact with the upper ends of the front side plates 6a and the pressing members 60a in attaching or detaching the cassette 1 to or from the image forming apparatus, the front side plates 6a are lowered and therefore the feed roller 10, the front side plates 6a, and the pressing members 60a are prevented from being deformed or damaged due to the collision with one another in attaching or detaching the cassette 1.

While each pressing member 60*a* is formed integrally with the front side plate 6*a* in this embodiment, these members may be formed separately. In this case, the slidable members 61*a* and the springs 62*a* are provided for each of the pressing members 60*a* and the front side plates 6*a* so as to make the pressing members 60*a* and the front side plates 6*a* movable upward and downward independently of each other.

Figure 6:
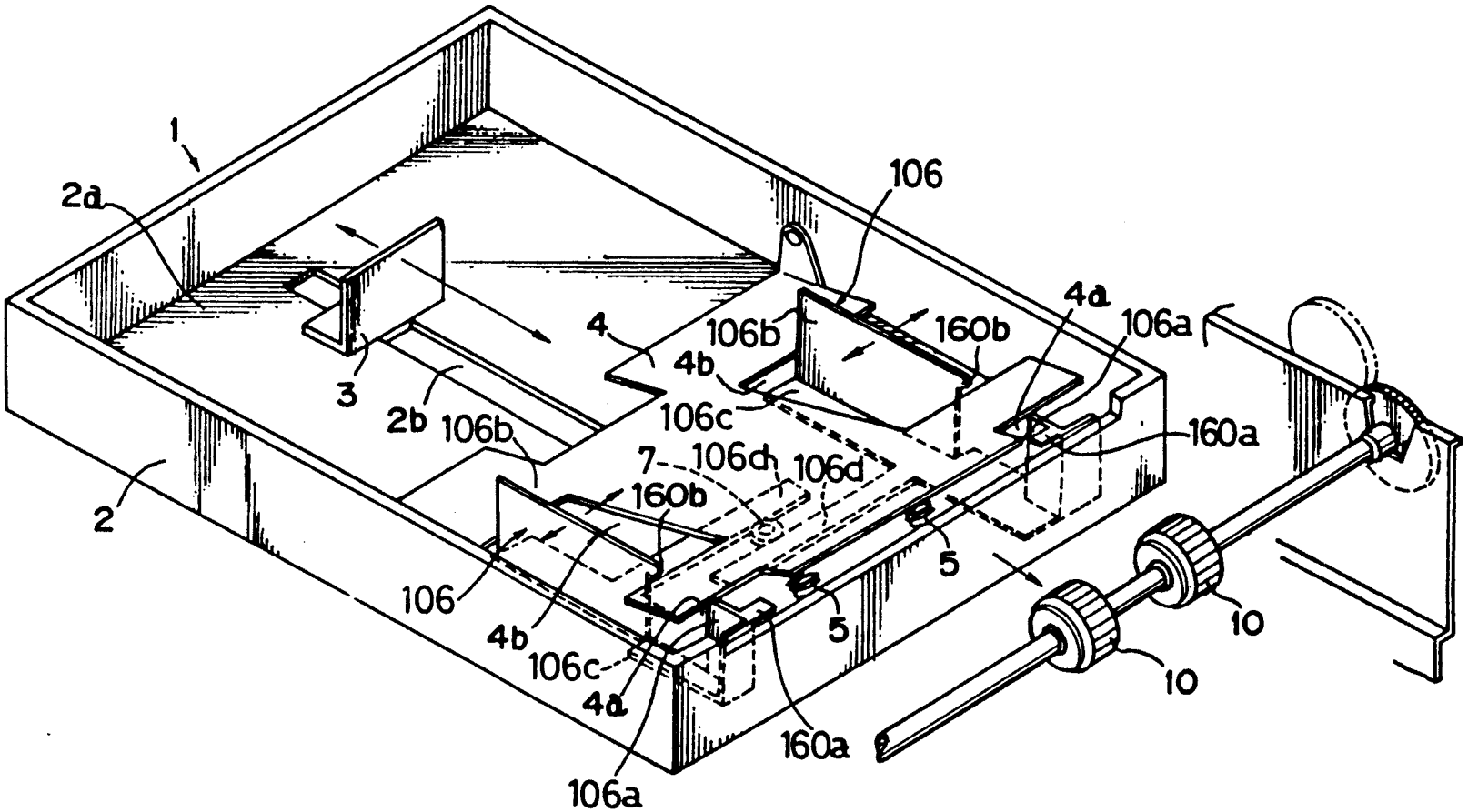
FIG. 6 is a perspective view showing a second cassette embodying the invention.

There will be described a second cassette embodying the invention next with reference to FIG. 6. This cassette 1 contains envelopes therein in this embodiment, and includes a cassette main body 2 formed into a box-like figure, a trailing edge regulating member 3, a sheet holding plate 4 for holding envelopes thereon, helical springs 5, a pair of side plates 106 arranged at left and right sides of the cassette main body 2, etc.

Each side plate 106 is made of a metal member, and consists essentially of integrally formed front side plate 106*a*, rear side plate 106*b*, base portion 106*c*, and rack portion 106*d*. The base portion 6*c* is held between a bottom plate 2*a* of the cassette main body 2 and the sheet holding plate 4. The front and rear side plates 106*a*, 106*b* are provided upright at front and rear ends of the base portion 106*c*, and are adapted for restricting a lateral movement of the envelopes so that the envelopes can be fed toward the feed roller 10 accurately. By forming the front and rear side plates 106*a*, 106*b* separately, the feed roller 10 is permitted to be positioned therebetween when the cassette 1 is attached to the image forming apparatus. Further. the front and rear side plates 106*a*, 106*b* are made movable within the width of the sheet holding plate 4 along a widthwise direction of the cassette 1, such that the cassette 1 is capable of containing therein not only cut sheets of large size but also envelopes of small size.

The rack portion 106*d* extends laterally inward of the cassette main body 2 from a specified inner lateral position of each base portion 106*c*. The rack portions 106*d* of the opposite side plates 106 are spaced apart by a given distance in parallel with each other, and are meshable with a pinion 7 mounted at a widthwise center of the bottom plate 2*a* therebetween. With this arrangement. the opposite side plates 106 are movable toward or away from each other simultaneously along the widthwise direction of the cassette 1. At the top of the front end of each front side plate 106*a* is formed a pressing member 160*a* extending laterally inward of the cassette main body 2. The pressing members 160 press downward a leading edge of the uppermost one of the envelopes placed on the sheet holding plate 4.

Figure 7:
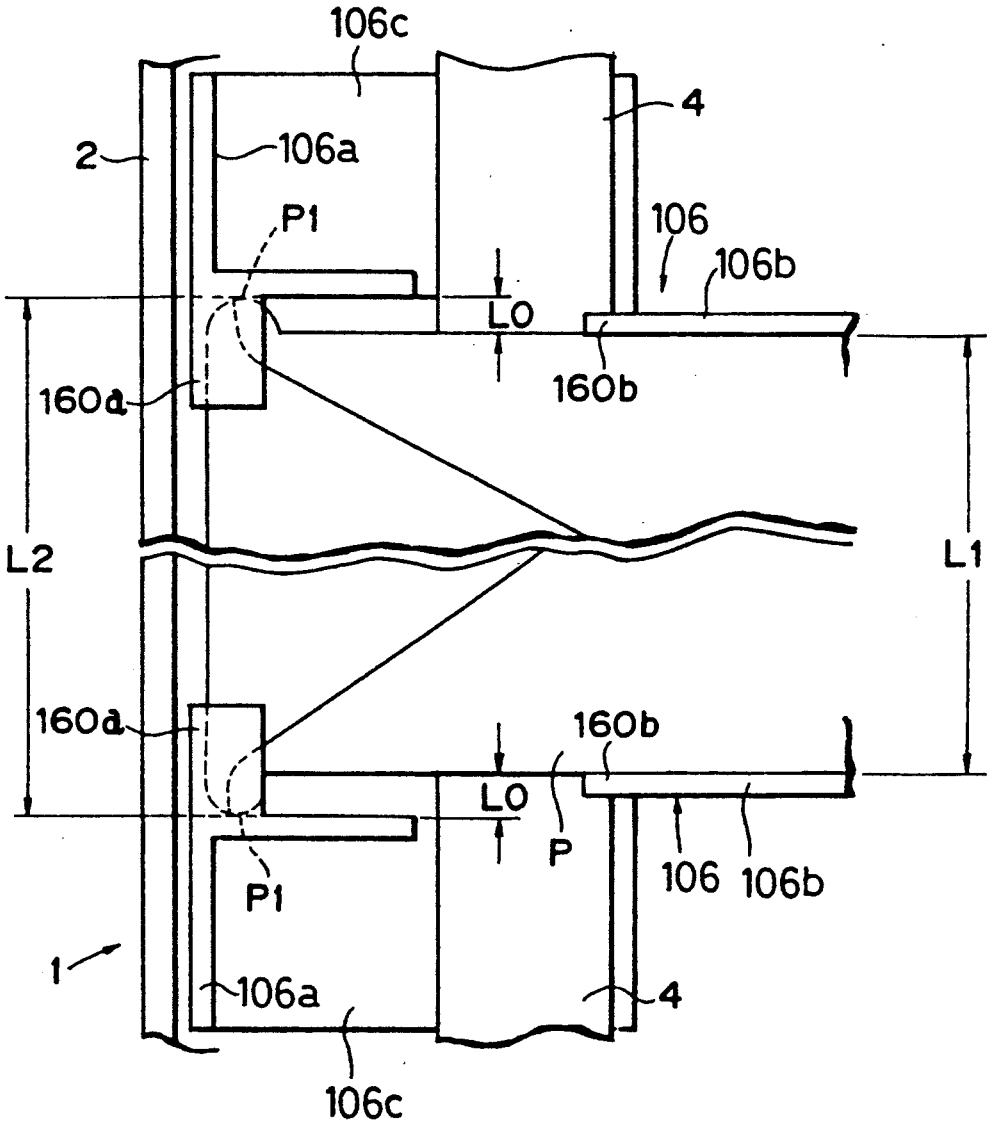
FIG. 7 is a front view showing a positional relationship between a front side plate and a rear side plate of the second cassette.

FIG. 7 is a fragmentary plan view showing the front side plates 106*a*. The front side plates 106*a* are formed such that the width thereof is greater than the rear side plates 106*b* by L0. Accordingly, the distance between the front side plates 106*a* is L2 (=L1+2L0) when the side plates 106 are moved and the rear side plates 106*b* come to contact with lateral edges of the envelopes of the width L1.

Figure 8:
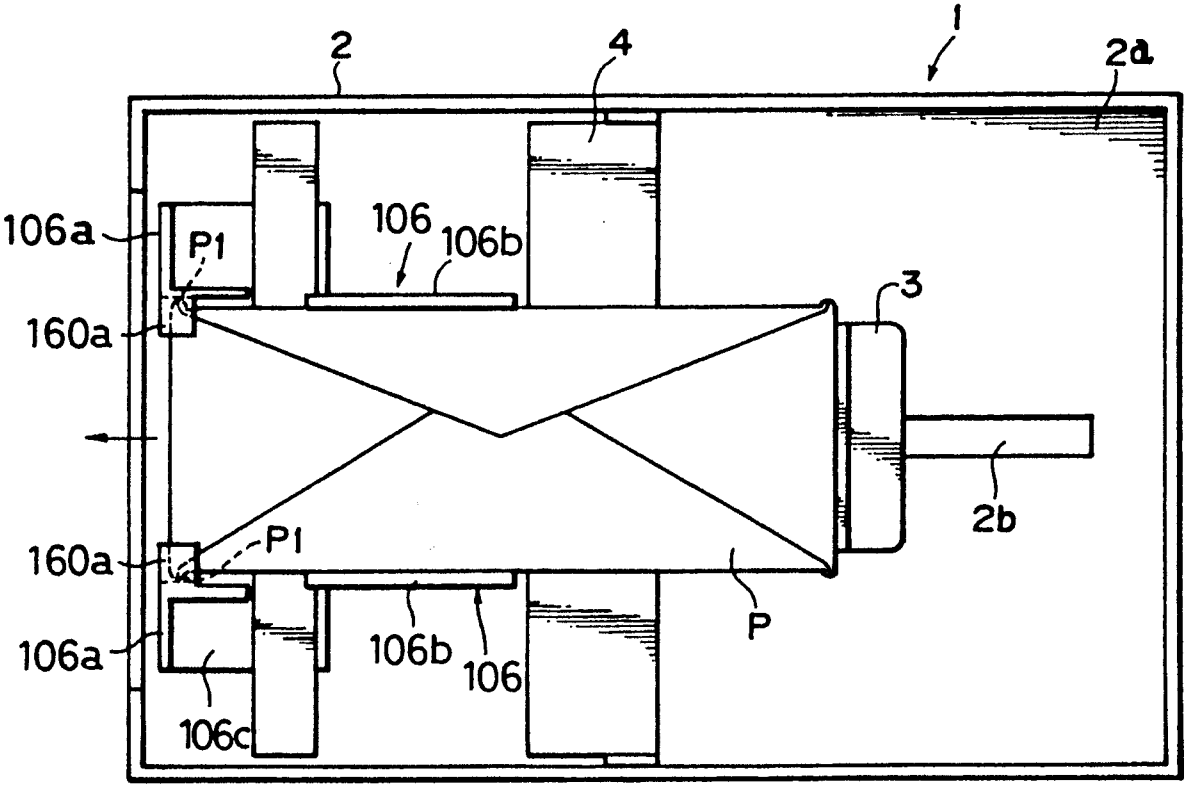
FIG. 8 is a front view showing the cassette.

The leading and trailing edges of the envelopes P are both aligned and positioned properly as shown in FIG. 8 by moving the trailing edge regulating member 3 to contact the same with the trailing edges of the envelopes P. Thereafter, the cassette 1 is attached to a printer, copying machine, or like image forming apparatus, and the envelopes P are fed one by one from the uppermost one by the feed roller 10.

Now, description will be given on the meaning of the distance L0.

Figure 9:
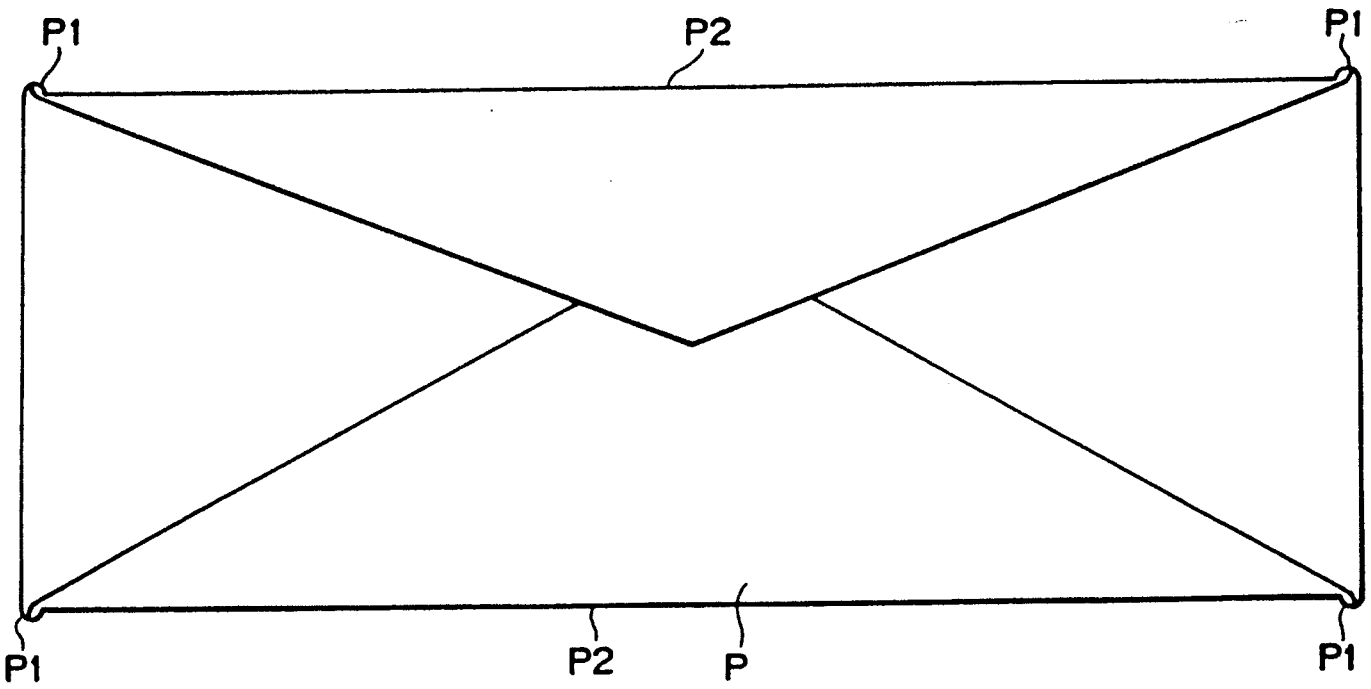
FIG. 9 is a front view showing an envelope.

Since the envelopes P are formed by folding a sheet into a flat container as shown in FIG. 9, some of them have four corners P1 projecting outward from sides P2 by about 0.3 mm. In the case where these envelopes P are contained in the cassette 1, these corners P1 generate an unnecessary pressing force between the front side plates 106*a*. This pressing force undesirably becomes a resistance against such a biasing force of the helical spring 5 as to elevate the envelopes P placed on the sheet holding plate 4, with the result that the envelopes P cannot be fed properly.

In consideration of a projected amount of the corners P1, the distance L0 is set so as to accommodate these corners P1 appropriately. For example, the distance L0 is set at about 1 mm. When the distance L0 is set at an exceedingly large value, the leading edges of the envelopes cannot be aligned reliably by the front side plates 106*a*, for example, in feeding the short envelopes, and thereby the likelihood of oblique feeding arises. However, if the distance L0 is set at about 0.6 mm to 1.5 mm, it does not affect a feeding direction of the envelopes.

With the above consideration, even when the envelopes P are used as sheets, the envelopes P are allowed to come to contact with the feed roller 10 without affecting the feeding direction of the envelopes P, and to be fed properly and reliably by the feed roller 10. In this embodiment, the rear side plates 106*b* are not in contact with the trailing edge portions of the envelopes P. This considers the existence of the outward projecting corners at the trailing edge portions of the envelopes P.

Although each side plate 106 includes the separately formed front and rear side plates 106*a*, 106*b* in this embodiment, the front and rear side plates may be formed integrally according to the invention. In this case, the side plates 106 are formed such that the distance between the front end portions thereof is greater than the distance between other portions thereof. Further, the distance L0 is preferably set in the aforementioned range of about 0.6 mm to 1.5 mm, but may be set outside this range.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A cassette attachable to an image forming apparatus which includes a feed roller comprising:

a cassette unit;

push-up means mounted on said cassette unit for pushing up leading edges of flat items placed in said cassette unit to bring the uppermost one of said flat items into contact with said feed roller;

restricting means movably mounted on said cassette unit for restricting movement of said flat items in said cassette unit;

said restricting means comprising forward guides for restricting forward and lateral displacement of said flat items in said cassette unit;

said forward guides comprising forward side walls for restricting lateral displacement of said flat items in said cassette unit, said forward side walls having an upper end surface;

said forward guides further comprising a front guide wall for restricting forward displacement of said flat items in said cassette unit, said front guide wall having an upper guide portion which is inclined upwardly and forwardly, said guide portion having an upper end surface;

said restricting means further comprising lateral pressing members extending laterally inwardly over said flat items for restricting upward movement of said flat items in said cassette unit;

said upper end surface of said forward side walls being continuous with said upper end surface of said guide portion such that when the cassette unit is being inserted into said image forming apparatus, said roller uninterruptedly engages said upper surface of said guide portion and said upper surface of said forward side walls.

2. A cassette according to claim 1 wherein said pressing members have a top surface, said restricting means being movably mounted on said cassette unit between an elevated position and a depressed position, biasing means for biasing said restricting means towards said elevated position, said cassette unit having an inserted position in said image forming apparatus, said upper end surface of said guide portion, said upper end surface of said forward side walls and said top surface of said pressing members engaging said roller during insertion of said cassette unit into said image forming apparatus such that the roller depresses said restricting means from said elevated position toward said depressed position, said restricting means being displaced from said roller when said cassette unit is disposed in said inserted position such that said biasing means biases said restricting means to said elevated position when said cassette unit is in its inserted position.

3. A cassette according to claim 2 wherein said pressing members are disposed forwardly of said roller when said cassette unit is in said inserted position.

4. A cassette according to claim 1 wherein said front guide wall comprises an upright front wall having an upper end, said guide portion extending upwardly and forwardly from said upper end of said upright front wall, said guide portion having lateral ends, said forward side walls extending forwardly of said upright front wall and being joined to said lateral ends of said inclined guide portion.

5. A cassette according to claim 1 wherein said forward side walls have an upper edge. which define said upper end surface of said forward side walls, said pressing members extending laterally from said forward side walls such that said top surfaces of said pressing members are continuous and planar with said upper edges of said forward side walls, said upper end surface of said guide portion being continuous and planar with said upper edges of said forward side walls.

6. A cassette according to claim 1 wherein said pressing members have a top surface, said cassette unit having an inserted portion in said image forming apparatus, said cassette unit being withdrawable from said image forming apparatus from said inserted position such that during withdrawal, said roller uninterruptedly engages said top surfaces of said pressing members, said upper end surfaces of said forward side walls and said upper end surface of said guide portion.

7. A cassette according to claim 6 wherein said upper end surface of said guide portion, said upper end surface of said forward side walls, and said top surface of said pressing members are disposed in a common plane.

8. A cassette according to claim 1 wherein said upper end surface of said guide portion and said upper end, surface of said forward side walls together form a continuous and uninterrupted surface disposed in a common plane.

9. A cassette according to claim 1 wherein said pressing members are spaced rearwardly of said leading edges of said flat items in said cassette unit.

10. A cassette according to claim 1 wherein said guide portion includes a friction member for preventing multiple feeding of sheets in cooperation with said feed roller.

11. A cassette for envelopes having projecting corners projecting outwardly from the lateral sides thereof, said cassette being attachable to an image forming apparatus which includes a feed roller, said cassette comprising:

a cassette unit;

push-up means mounted on said cassette unit for pushing up leading edges of said envelopes placed in said cassette unit to bring the uppermost one of said envelopes into contact with said feed roller;

first restricting means comprising forward guides for restricting upward and lateral displacement of said envelopes in said cassette unit;

said forward guides comprising two spaced forward side walls for restricting lateral displacement of said envelopes in said cassette unit;

pressing members on said first restricting means extending laterally inwardly over said envelopes for restricting upward movement of said envelopes in said cassette unit;

second restricting means disposed rearwardly of said first restricting means for restricting lateral displacement of said envelopes in said cassette unit, said second restricting means comprising two spaced intermediate side walls;

said two spaced forward side walls being laterally spaced from one another a first distance, said two spaced intermediate side walls being spaced from one another a second distance, said first distance being greater than said second distance such that said two spaced forward side walls are more widely spaced than said two spaced intermediate side walls, said projecting corners at the leading end of said envelopes in said cassette unit being accommodated between said two more widely spaced forward side walls.

12. A cassette according to claim 11 wherein said forward side walls have an upper end surface, said pressing members having a top surface, said upper end surface of said forward side walls being continuous with said top surface of said pressing members such that when the cassette unit is being inserted into said image forming apparatus, said roller uninterruptedly engages said upper surface of said forward side walls and said top surface of said pressing members.

13. A cassette according to claim 11 wherein said pressing members extend laterally inwardly from said forward side walls.

14. A cassette according to claim 11 wherein said first restricting means further comprises a front guide wall for restricting forward displacement of said envelopes in said cassette unit, said front guide wall forming a right angled corner with said forward side wall, said pressing members being disposed at said right angled corner.

15. A cassette according to claim 11 wherein the difference between said first and second distances is designated a lateral differential distance, further comprising coupling means coupling said first and second restricting means and operable to adjust said first and second distances while maintaining constant said lateral differential distance.

16. A cassette according to claim 11 wherein the spacing between one forward side wall of one forward guide on one side of said cassette unit and one intermediate side wall of one of the second restricting means on the same side of said cassette unit is between 0.6 mm and 1.5 mm.

* * * * *